US008715141B2

(12) United States Patent
Bes

(10) Patent No.: US 8,715,141 B2
(45) Date of Patent: May 6, 2014

(54) FITNESS DEVICE AND PRODUCTION METHOD

(76) Inventor: Claude Bes, Montpellier (FR)

( * ) Notice: Subject to any disclaimer, the term of this patent is extended or adjusted under 35 U.S.C. 154(b) by 0 days.

(21) Appl. No.: 13/985,027

(22) PCT Filed: Mar. 14, 2012

(86) PCT No.: PCT/FR2012/000089

§ 371 (c)(1),
(2), (4) Date: Sep. 12, 2013

(87) PCT Pub. No.: WO2012/123650

PCT Pub. Date: Sep. 20, 2012

(65) Prior Publication Data

US 2013/0345028 A1 Dec. 26, 2013

(30) Foreign Application Priority Data

Mar. 14, 2011 (FR) ..... 11 00753
Nov. 22, 2011 (FR) ..... 11 03538

(51) Int. Cl.
*A63B 22/04* (2006.01)

(52) U.S. Cl.
USPC ..... 482/52

(58) Field of Classification Search
CPC ..... A63B 5/08; A63B 21/02; A63B 21/04; A63B 21/045; A63B 22/00; A63B 22/0048; A63B 22/0056; A63B 22/0058; A63B 2021/02; A63B 2022/00; A63B 2022/0025; A63B 2022/0033; A63B 2022/0038; A63B 2022/0048
USPC ..... 482/51–53, 70–71, 79–80, 92, 121, 482/127–130, 141; D21/668, 670, 671, 685
See application file for complete search history.

(56) References Cited

U.S. PATENT DOCUMENTS 1,587,749 A * 6/1926 Bierly ..... 482/80
5,069,445 A 12/1991 Mai
5,232,419 A 8/1993 Kozak
5,352,173 A * 10/1994 McLaughlin ..... 482/123
5,634,870 A * 6/1997 Wilkinson ..... 482/30
D383,813 S * 9/1997 Zoller ..... D21/685

FOREIGN PATENT DOCUMENTS

DE 34 25 200 A1 2/1985
GB 2 472 803 A 2/2011

OTHER PUBLICATIONS

International Search Report, Jul. 2, 2012, from International Phase of the instant application.

* cited by examiner

*Primary Examiner* — Oren Ginsberg
(74) *Attorney, Agent, or Firm* — Jackson Patent Law Office

(57) ABSTRACT

The invention relates to a fitness device for exercising the lower limbs, characterized in that the pedals (112), the frame (12) and the various means (13) for articulation, pressure resistance and pedal-restoring, are designed as a single component, consisting of at least one single plate (1) in an elastic material in a V shape with a rounded apex or a U shape with parallel or flared branches, one of the branches (11) thereof being provided with an opening (111) opening up at the base of the "V" or the "U", for forming the two pedals (112), the other branch (12) thereof forming the frame for the two pedals, and each rounded apex (13) thereof that connects each pedal (112) to the frame (12) forming, as a single component, the means for articulation, pressure-resistance and restoring each pedal.

7 Claims, 2 Drawing Sheets

FITNESS DEVICE AND PRODUCTION METHOD

FIELD OF THE INVENTION

The invention relates to the field of fitness devices designed for the exercise of the lower limbs. It also relates to its method of manufacturing.

TECHNICAL BACKGROUND

The related prior art is that of devices for walking, called "mini steppers", marketed for numerous years by large retailers and specialty stores and essentially described in the patent FR2791266.

They are of the type comprising:

- two pedals designed to be alternately actuated by the lower limbs of the user;
- a common frame resting on the ground;
- a means designed to connect, in an articulated manner, each pedal to the frame;
- a means, positioned between each pedal and the frame, designed to oppose a resistance to the pressure exerted on each pedal by of the lower limbs;
- a means, positioned between the pedals and the frame, designed to produce a restoring force adapted to bring back up the pedal that is no longer actuated by the corresponding lower limb and well as the aforementioned limb.

They have the main drawbacks tied to the fact that the means identified above are implemented by mechanical devices (joints, hydraulic dampers, rods, pins, pulleys, . . . ) that have many points of wear and noise disturbances requiring their regular lubrication and the frequent return of the devices for repair, even replacement, as they are not suitable for intensive use.

In addition, they are heavy and bulky and difficult to transport for, for example, use outside the home during weekends or holidays.

For example, a mini stepper has overall dimensions 450×300×340 mm, weighs approximately 6 kg and is only guaranteed 12 months for non-intensive use (10 minutes per day).

SUMMARY OF THE INVENTION

The invention aims to implement an exercise device for the exercise of lower limbs, eliminating the aforementioned drawbacks.

The device according to the invention is of simple design, easy to implement, inexpensive, designed for intensive use, requires no maintenance, lightweight, compact, easy to store and transport, in other words a device that eliminates the drawbacks mentioned above.

In order to meet these various objectives, the pedals, the frame and various mechanical means providing the various functions of articulation, resistance to pressure and return of the pedals have been made, fully integrated, by means of a single plate, made of elastic material in "V" shape with a rounded vertex, or "U" shape with parallel or flared branches;

- one of the branches thereof being provided with an gap reaching to the base of the "V" or "U", adapted to form the two pedals;
- the other branch thereof forms the frame common to the aforementioned pedals;
- the rounded vertex thereof, which connects each pedal to the frame forms, in itself alone, the means for articulation, resistance to pressure, and return of each pedal.

For a better operation of the pedals, the gap or slot is extended in at least part of the rounded vertex or in a part of the common frame.

The device in question is thus designed as a single piece, called monobloc. It can be made by a method that comprises:

a) using an elastic plate whose width corresponds to the overall width common to the pedals, the frame (or platform) and the rounded vertex and whose overall length corresponds to the sum of lengths of the branches and rounded vertex of the finished product, in other words of its layout;

b) cutting, directly in the aforementioned plate, the gap designed to form the pedals;

c) forming it into a "V" or "U" with parallel or flared branches, preferably symmetrically.

It can also be made, in a single piece, by means of a method that comprises injecting composite or plastic material into an adapted mold.

The plate may be made of a material selected from metal, wood, plastic, thermoplastic or thermosetting materials, or any other material (plywood, reeds, . . . ).

The making of the device in a single piece, the use of large scale production techniques, and the elimination of any mechanical part enabled essentially:

- to significantly reduce the weight and the cost of the devices;
- to increase significantly their reliability and endurance;
- to eliminate all device maintenance and replacement due to technical failure or wear;
- mainly by the use of composite materials.

In addition, having low inertia, the device is also useable for jogging which is not the case of devices of this type on the market today. The operation of the device for walking or jogging is:

- Phase 0: the blades are in high position;
- Phase 1: the right foot (for example) exerts a pressure on the corresponding pedal until it bears on the frame;
- Phase 2: the left foot is positioned on the other pedal and the weight of the body passes from the right pedal to the left pedal, the lower right limb rises under the effect of the restoring force and the transfer of weight;
- Following phases: successive transfers of weight from one pedal to the other.

The device is also characterized in that it can be used for trampolining when resting on the ground via its pedals, in other words in inverted position, the frame then acting as a platform for jumping and exercises ranging from hopping to different movements comprising rocking the platform in all directions.

The health benefits of such a device are the following:

- protection of the joints (ligaments, tendons) that are no longer subject to shocks;
- increase of the flow of lymphatic drainage and venous return by working of the arch and calf;
- augmentation of energy level by activating blood circulation and augmenting cardiac function and metabolism;
- increase in balance and postural maintenance;
- reduction of fat mass.

PRESENTATION OF FIGURES

The features and advantages of the invention will appear more clearly on reading the detailed description that follows of at least one of its preferred implementation mode given by way of non-limiting example and shown in the accompanying drawings.

DETAILED DESCRIPTION OF THE INVENTION

Figure 1:
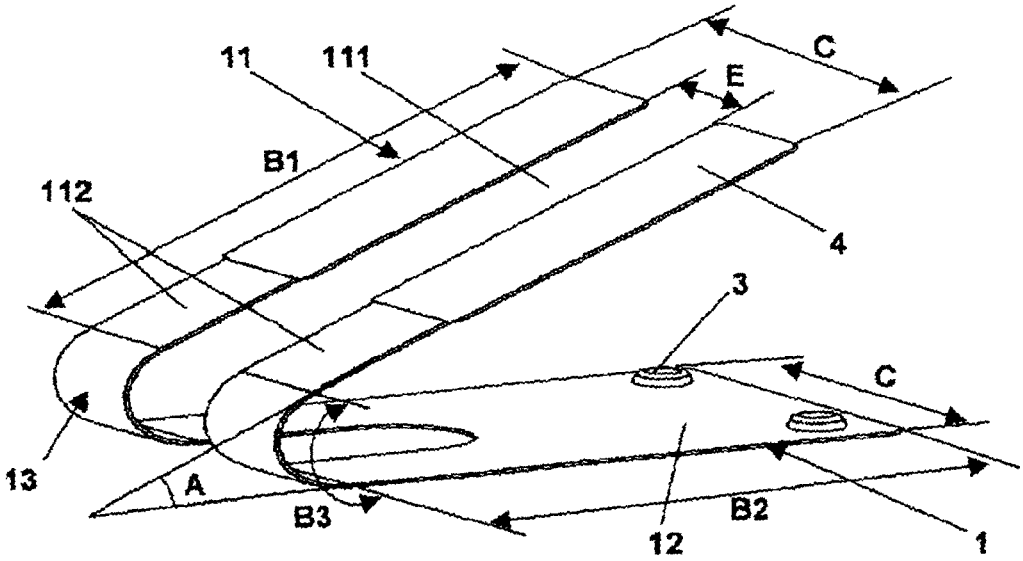
FIG. 1 is a perspective view of the device made by means of a single plate, in « V» shape, integrating the two pedals, the common frame and the means for articulation, for resistance to the pressure and return of the pedals.
Figure 2:
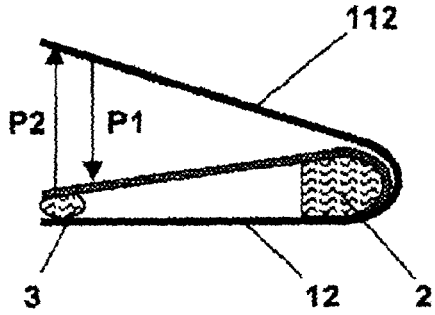
FIG. 2 is a basic schematic, in profile, of the device emphasizing the bending and extension pedals and the positioning of supplemental dampening means.
Figure 3:
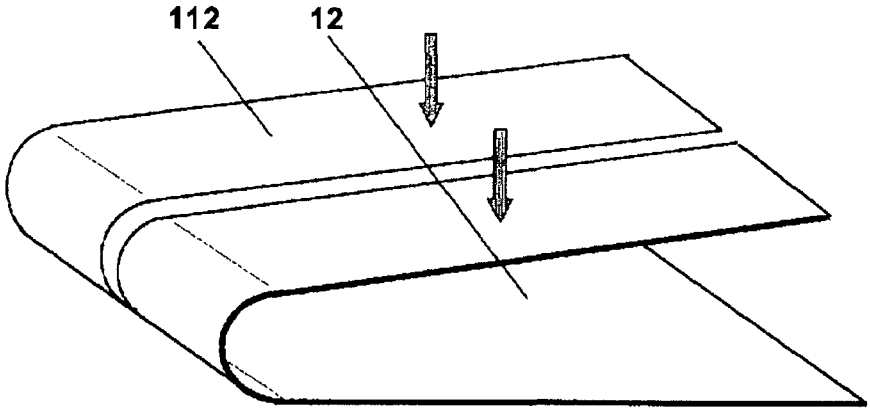
FIG. 3 is a perspective view of the device in position of platform resting on the ground.
Figure 4:
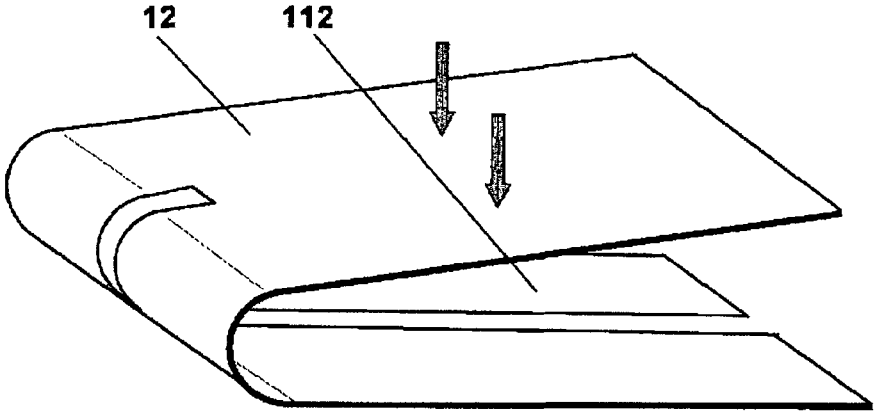
FIG. 4 is a perspective view of the device in position of pedals resting on the ground.

The device shown in the figures is of the type comprising:

- two pedals (112) designed to be alternately actuated by the lower limbs;
- a common frame (12), or platform, resting on the floor;
- a means (13) designed to connect, in an articulated manner, each pedal (112) to the aforementioned frame (12);
- a means (13), positioned between each pedal (112) and the frame (12) designed to oppose a resistance to the pressure exerted on each pedal by each of the lower limbs;
- a means (13), positioned between each pedal and the frame, designed to produce a restoring force adapted to bring back up the pedal that is no longer actuated by the corresponding lower limb as well as the aforementioned limb.

It is essentially characterized the in that the pedals (112), the frame (12) and the various means (3) for articulation, resistance to the pressure, and return of the pedals are made in complete integration by means of a single plate (1) made of elastic material, in "V" shape with a rounded vertex, or "U" shape with parallel or flared branches, one of the branches (11) thereof being provided with a gap (111) reaching to the base of the "V" or "U", adapted to form the two pedals (112), the other branch (12) thereof forms the frame common to the aforementioned pedals and each rounded vertex (13) thereof, which connects each pedal (112) to the frame (12) forms, in itself alone, the means for articulation, resistance to pressure, and return of each pedal.

According to implementation details of the invention, the gap (111):

- is extended in a portion of the rounded vertex (13);
- traverses the entire rounded vertex (13) and extends into a portion of the common frame (12).

According to other implementation details of the invention, the device may comprise:

- an interchangeable means (2), made of elastic material, interposed between each pedal (112) and the common frame (12), designed to exert an opposition force supplemental to that produced by the rounded vertex (13) of the plate (1);
- a means (3), made of elastic material, interposed between the end of each pedal (112) and the end facing the common frame (12), designed to dampen the end of stroke of each pedal.

According to other of implementation details of the invention, the plate (1) can be:

- made of a material selected from metal, wood, plastic material, thermoplastic or thermosetting composite materials, or any other material (plywood, reeds, . . . );
- made by stacking sheets of different materials joined together;
- have a general shape selected from square, rectangular or trapezoidal shapes, straight or rounded sides.

A first method of manufacturing the device according to the invention comprises:

a) using an elastic plate (1) whose width corresponds to the overall width (C) common to the pedals (112), the frame (2) and a rounded vertex (3) and whose overall length corresponds to the sum of respective lengths (B1), (B2) and (B3) of the branches (11) and (12) and the vertex (13);

b) cutting the gap (111) directly in the plate (1);

c) forming the aforementioned plate (1) into a "V" or a "U".

Of course, the gap (111) could be made after forming the plate but this solution would be less practical on an industrial scale.

A second method of manufacturing the device, according to the invention, comprises obtaining the aforementioned device, in a single piece, by injection of composite or plastic material.

In preferred implementations of the invention, the device can be obtained:

- by thermoforming a single plate made of composite thermoplastic material, in particular mode of "glass-polypropylene";
- by thermal compression of sheets or folds, of composite thermo plastic material, in particular made of "glass-polypropylene";
- or by injection molding of plastic or composite materials.

According to the implementation details of the invention, the device, after being made, can be:

- entirely dipped into a bath of non-slip and colored material;
- wrapped, at the pedals and/or chassis, by means of a non-slip and colored envelope.

With the use of composite materials, the device can be guaranteed for at least 1 million cycles which will allow intensive home use as well as indoors (in a larger size) over at least 2 to 3 years without any maintenance or return for repair or replacement.

By way of non-limiting example, the household device has the following features:

- overall dimensions: length=370 mm, width=300 mm and height=160 mm;
- Width of the cut out (E): chosen between 5 and 30 mm, preferably on the order of 10 mm;
- Angle A (at rest): chosen between 0° and 30°, preferably equal to 15°;
- radius of the vertex: between 15 and 40 mm, preferably equal to 30 mm;
- elastic pedal resistance: a value (P1) chosen, in a non-limiting manner, between 20 kg at start of stroke and 60 kg at end of stroke (measured at the end of each pedal).

In this configuration, the weight of the entire device is less than 3 kg.

The modulus of elasticity of the plate is defined for, first, a first frame and pedals of a sufficient stiffness and, second, a vertex whose elasticity meets the requirements for use.

The modulus of elasticity of the plate is defined by assaying the fibers and the resin as well as the thickness of the composite material.

Obviously, the dimensions of the pedals (width and length) also act on the elasticity and stiffness characteristics.

It is also possible to modify the pressure resistance by changing the modulus of elasticity of the interchangeable means (2).

The inertia of the device being low, the user can choose the pace and travel of the pedals. In addition, he can position himself more, or less, in front of or behind the pedals in order to modify the resistance to the force.

To work the entire body, the user will be able to, in walking or jogging movement, place in his hands, either free weights, or a handle connected to an elastic cord (not shown), such as "bungee cord", attached to the device or to his body.

This is especially advantageous as, in the natural movement of walking or jogging, when the pedal goes down the upper limb located on the same side moves forward and reciprocally when the pedal comes back up.

Originally designed to replace the devices intended for walking exercise, the device according to the invention can be used either as:

device for walking and jogging when it rests on the ground via its frame (12);

device for trampolining when it rests on the ground via its pedals (112), the frame (12) thus acting as a jumping or exercise platform.

Of course, the person of skill in the art will be able to make the invention as described and shown by applying and adapting known means.

He will also be able to provide other variations without departing from the scope of the invention, which is determined by the terms of the claims.

The invention claimed is:

1. A fitness device designed for the exercise of the lower limbs, comprising:

two pedals designed to be actuated alternately by the lower limbs;

a common support designed to rest on the floor;

a means designed for connecting, in an articulated manner, each pedal to the support;

a means positioned between each pedal and the support designed to oppose a resistance to the pressure exerted on each pedal by each of the lower limbs;

a means positioned between each pedal and the support, designed to produce a restoring force adapted to bring up the pedal that is no longer actuated by the corresponding lower limb as well as the corresponding limb;

characterized in that the pedals, the support and the means designed for connecting, means designed to oppose, and means designed to produce a restoring force are made in complete integration by means of a single plate made of elastic material, in "V" shape with a rounded vertex, or "U" shape with parallel or flared branches, one of the branches thereof being provided with a gap reaching to the base of the "V" or "U", adapted to form the two pedals, the other branch thereof forms the support common to the pedals and each rounded vertex thereof, which connects each pedal to the support forms, in itself alone, the means for articulation, resistance to pressure, and return of each pedal.

2. A device, according to claim 1, further including an interchangeable means, made of elastic material, interposed between each pedal and the common support, designed to exert an opposition force supplemental to that produced by the rounded vertex of the plate.

3. A device, according to claim 1, further including a means, made of elastic material, interposed between the end of each pedal and the end facing the common support, designed to dampen the end of stroke of each pedal.

4. A device as described in claim 1, designed for walking and jogging when the device rests on the ground via the support.

5. A device as described in claim 1, designed for trampolining when the device rests on the floor via the pedals, the support thus acting as a jumping or exercise platform.

6. A device according to claim 1 further comprising a non-slip and colored envelope that wraps the pedals.

7. A device according to claim 1 further comprising a non-slip and colored envelope that wraps the support.

* * * * *